United States Patent [19]

Maejima et al.

[11] Patent Number: 4,664,775

[45] Date of Patent: May 12, 1987

[54] METHOD FOR MANUFACTURING LOW POUR POINT PETROLEUM PRODUCT WITH ZEOLITE TSZ

[75] Inventors: Tsugio Maejima; Wataru Kobayashi; Kenji Ashibe; Nobuaki Tagaya; Satoshi Sakurada, all of Saitama, Japan

[73] Assignee: TOA Nenryo Kogyo Kabushiki Kaisha, Tokyo, Japan

[21] Appl. No.: 517,372

[22] Filed: Jul. 26, 1983

[30] Foreign Application Priority Data

Jul. 31, 1982 [JP] Japan ..... 57-134454

[51] Int. Cl.[4] ..... C10G 47/20; C10G 65/12

[52] U.S. Cl. ..... 208/89; 208/97; 208/111; 208/92; 502/71; 423/328

[58] Field of Search ..... 208/89, 97, 111, 92, 208/100; 502/64, 71; 423/328, 328 T

[56] References Cited

U.S. PATENT DOCUMENTS

| | | | |
|---|---|---|---|
| Re. 28,398 | 4/1975 | Chen et al. | 208/111 |
| 3,700,585 | 10/1972 | Chen et al. | 208/111 |
| 3,702,886 | 11/1972 | Argauer et al. | 423/328 |
| 3,894,938 | 7/1975 | Gorring et al. | 208/97 |
| 4,137,148 | 1/1979 | Gillespie et al. | 208/87 |
| 4,175,114 | 11/1979 | Plank et al. | 423/329 |
| 4,257,885 | 3/1981 | Grose et al. | 423/328 |
| 4,275,047 | 6/1981 | Whittam | 423/329 |
| 4,294,687 | 10/1981 | Pinaire et al. | 208/58 |
| 4,325,804 | 4/1982 | Everett et al. | 208/58 |
| 4,420,467 | 12/1983 | Whittam | 502/61 |
| 4,572,779 | 2/1986 | Iwayama et al. | 208/111 |

FOREIGN PATENT DOCUMENTS

| | | | |
|---|---|---|---|
| 0065401 | 11/1982 | European Pat. Off. | 208/328 |
| 0007819 | 1/1982 | Japan | 423/328 |
| 0143396 | 3/1983 | Japan . | |
| 0199714 | 11/1983 | Japan | 502/60 |

OTHER PUBLICATIONS

"Structure of Synthetic Zeolite ZSM-5", Kokotailo et al., *Nature,* vol. 272, Mar., 1978, pp. 437-438.

"ZSM-5 Type Materials Factors Affecting Crystal Symmetry", Wu et al., *The Journal of Physical Chemistry,* vol. 83, No. 21, 1979, pp. 2777-2781.

*Primary Examiner*—Olik Chaudhuri

*Attorney, Agent, or Firm*—Joseph J. Allocca

[57] ABSTRACT

This invention relates to a method for catalytically manufacturing a low pour point petroleum product from distillates of crude oil, and more particularly to a method for economically manufacturing a low pour point petroleum product, such as the insulating oil, the lubricating oil used for various types of freezing devices, or the base oil for such lubricating oil, from a paraffin-based crude oil as the starting material without using any special rare crude oil such as naphthene-based crude oil. The catalyst comprises zeolite TSZ.

12 Claims, 3 Drawing Figures

METHOD FOR MANUFACTURING LOW POUR POINT PETROLEUM PRODUCT WITH ZEOLITE TSZ

DETAILED DESCRIPTION OF THE INVENTION

This invention relates to a method for manufacturing a low pour point petroleum product from distillates of crude oil, and more particularly to a method for economically manufacturing a low pour point petroleum product, such as the insulating oil, the lubricating oil used for various types of freezing devices, or the base oil for such lubricating oil, from a paraffin-based crude oil as the starting material without using any special rare crude oil, such as naphthene-based crude oil.

Heretofore, the raw material accepted as usable for the manufacture of such petroleum products of low pour point as insulating oil, refrigerating machine oil, and lubricating base oil has been limited to naphthene-based crude oil. Unfortunately, the naphthene-based crude oil is produced in a small amount. There are all indications that the supply of this particular crude oil in the future will keep pace with the demand for such petroleum products of low pour point with increasing difficulty.

Various attempts have been made to obtain the petroleum products of low pour point from the paraffin-based crude oil. They still have problems yet to be solved. The first problem is that when the dewaxing treatment inevitably required to be performed during the manufacture of a petroleum product of low pour point for the purpose of removing wax component and lowering the pour point is carried out by the ordinary solvent dewaxing via the propane method of MEK method, the largest possible decrease of the pour point is to the level of about −20° C. Thus, the attainment of the upper limit of pour point, −27.5° C. fixed by JIS (Japanese Industrial Standard) (for insulating oil No. 2 and refrigerating machine oils No. 2 and No. 3), or −35° C. fixed similarly (for refrigerating machine oil No. 1), is generally impracticable. The still lower pour point of not more than −40° C. which a certain special lubricant base oil is required to satisfy can hardly be attained.

Recently, there has been proposed a catalytic dewaxing method which obtains a petroleum product of low pour point by treating paraffin-based crude oil as raw material with a crystalline zeolite like ZSM-5 as a catalyst, thereby removing wax from the crude oil by the resultant catalytic reaction. This method has not proved quite satisfactory in terms of yield and pour point of the finished petroleum product of low pour point.

After various studies and experiments, it has been found that for the catalytic dewaxing method to be performed in a satisfactory manner on the paraffin-based crude oil as the raw material the selection of the catalyst, the conditions for the dewaxing operation, and the treatments to be given to the raw material or the product before and after the dewaxing operation must be optimized.

It has been discovered that crystalline zeolite TSZ advantageously serves as the catalyst. The crystalline zeolite TSZ is preferably used in a form of hydrogen-type or metal ion-exchanged type or in a form of metal impregnated type.

This metal is at least one member selected from the group consisting of the elements of Group VIII (iron family and platinum family) and Group IIA (alkaline earth metals) of the Periodic Table of Elements. Preferably, it is at least one member selected from the group consisting of nickel, palladium and platinum. By "zeolite TSZ" is meant what is disclosed in Japanese Patent Application No. 143396/1981 filed by the applicants of the present invention. More specifically, the zeolite TSZ is a crystalline aluminosilicate comprising a chemical composition which, in the molar ratio of oxides, is expressed by the following formula:

$$0.8\text{–}1.5M_{2/n}O:Al_2O_3:10\text{–}100/SiO_2:ZH_2O$$

(wherein M denotes at least one metallic cation species, n the valency of the metallic cation, and Z a numeral of the value of 0 to 40) and possesses a specified X-ray power diffraction pattern at least exhibiting interplanar spacing shown in Table 1.

TABLE 1

| Interplanar Spacing, d (Å) | Relative Intensity ($I/I_o$) |
|---|---|
| 11.2 ± 0.2 | S. |
| 10.1 ± 0.2 | S. |
| 7.5 ± 0.15 | W. |
| 6.03 ± 0.1 | M. |
| 3.86 ± 0.05 | V.S. |
| 3.82 ± 0.05 | S. |
| 3.76 ± 0.05 | S. |
| 3.72 ± 0.05 | S. |
| 3.64 ± 0.05 | S. |

It has now been discovered that a petroleum product of low pour point can be obtained in high yields by a method combining the catalytic dewaxing operation utilizing the aforementioned zeolite TSZ and a hydrofining process.

The catalyst to be used in this invention is prepared by converting the zeolite TSZ of the aforementioned description through a treatment with ammonium chloride into a hydrogen-form TSZ, impregnating the aforementioned metal, and blending the metal-loaded hydrogen-form TSZ with alumina, clay, silica, silica-alumina, or a metal oxide (such as, for example, zirconia or magnesia) as a binder. The amount of the binder thus added is generally in the range of 5 to 50%, and preferably in the range of 15 to 30%. It has been found, however, that a catalyst consisting solely of TSZ and containing none of the aforementioned binder can be effectively used for the purpose of this invention.

It is, therefore, an object of this invention to provide a method for manufacturing in high yields a petroleum product of low poor point of not more than −20° C. from paraffin-based crude oil as the raw material.

The method for the manufacture of the petroleum product of low pour point by the present invention, in summary, comprises:

(1) using as starting material a paraffin-based crude oil such as, for example, Arabian Light;

(2) fractionating the crude oil thereby into a distillate of boiling points in the range of 330° F. to 900° F. (166.6° C. to 482.2° C.), (raw oil);

(3) subjecting, or not subjecting the raw oil to a preliminary hydroforming step at the descretion of the practioner;

(4) passing the raw oil through a fixed-bed reactor packed with a catalyst containing zeolite TSZ under pressure of hydrogen (the feed gas should be at least 50% hydrogen) at a prescribed reactor temperature at a prescribed flow rate, thereby effecting catalytic dewaxing for the wax component of the raw oil into more volatile hydrocarbons and eliminating the wax component therefrom;

(5) distilling the product of the catalytic dewaxing to afford a petroleum product of low pour point satisfying the specification requirements of the desired product, with due consideration paid to flash point or viscosity;

(6) preferably performing hydrofining before or after the aforementioned distillation where the raw oil resulting from the catalytic dewaxing operation has not yet been subjected to hydrofining, or subjecting the raw oil as occasion demands to a further hydrofining where the raw oil has been treated in advance of catalytic dewaxing to a hydrofining step; and (7) further, for the purpose of adjusting the specification by the product or further improving the quality of the product, giving to the raw oil or the oil resulting from the catalytic dewaxing operation an aftertreatment, such as with clay, depending on the extent to which the hydrofining has been effected.

Catalytic dewaxing is conducted at a temperature in the range of 260° C. to 400° C., a liquid space velocity in the range of 0.1 to 5.0 V/H/V, a pressure in the range of 10 to 60 kg/cm$^2$G, and a feed gas rate in the range of 35 to 900 liters of gas per liter of oil. Hydrofining is conducted at a temperature in the range of 250° C. to 370° C., a liquid space velocity in the range of 0.1 to 5.0 V/H/LV, a pressure in the range of 10 to 60 kg/cm$^2$G, and a feed gas rate in the range 35 to 900 liters of gas per liter of oil. The hydrofining catalyst is one of the typical commonly used types such as those obtained by having at least one member from among Ni, Co, Mo and W compounds impregnated on alumina or silica-alumina.

Figure 1:
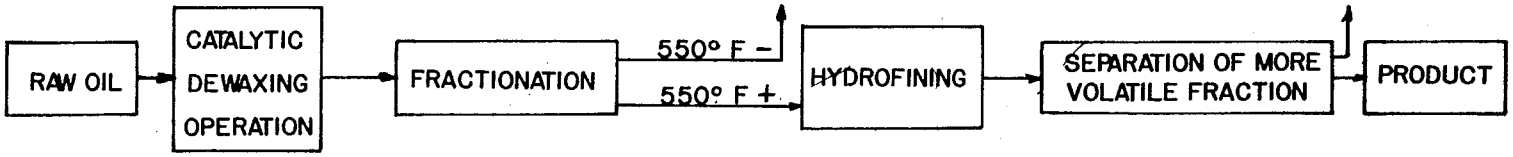
FIGS. 1, 2 and 3 are schematic outlines of three alternate process sequences within the scope of the present invention.

By the manufacturing method of the present invention practiced as described above, a petroleum product of low pour point can be economically obtained from the paraffin-based crude oil in higher yields than by the conventional solvent dewaxing and catalytic dewaxing methods.

The present invention will be described below with reference to the working examples which are presented by way of examples and not limitation.

EXAMPLE 1

The catalyst used in the catalytic dewaxing operation consisted of 70 weight percent of zeolite TSZ (containing 0.8 weight percent of Ni) and 30 weight percent of alumina as a binder.

This zeolite TSZ was prepared as follows:

In 510 g of purified water, 12 g of aluminum sulfate was dissolved. By adding 17.1 g of concentrated sulfuric acid (95 weight percent) and 54 g of sodium chloride to the resultant solution there was obtained aluminum sulfate solution. This aluminum sulfate solution was mixed under continued stirring into a mixed solution of 75 g of water and 189 g of water glass (containing 9.5 weight percent of $Na_2O$ and 28.6 weight percent of $SiO_2$) (water glass, No. 3, specified by Japanese Industrial Standard), to afford an aqueous reaction mixture having a composition represented, in molar ratio of oxides, as $3.9Na_2O.Al_2O_3.50SiO_2.2184H_2O$. The sodium chloride used in this case as a mineralizing agent had a $Cl/SiO_2$ molar ratio of 1.02. The aqueous reaction mixture was placed in a stainless steel autoclave, heated to an elevated temperature, and kept heated at 180° C. for 20 hours under autogenous pressure The crystallized solid product was separated by filtration, washed with water, and dried at 110° C. Chemical analysis of a sample of the solid product produced revealed it to have a chemical composition of 2.6 weight percent of $Na_2O$, 4.23 weight percent of $Al_2O_3$, 84.8 weight percent of $SiO_2$, and 8.4 weight percent of $H_2O$. This composition may be rewritten in molar ratio of oxides as follows:

$$1.01Na_2O.Al_2O_3.34.1SiO_2.11.2H_2O$$

When this product was subjected to x-ray analysis, the results shown in Table 2 were obtained.

TABLE 2

| Interplanar Spacing d (Å) | Relative Intensity $I/I_o$ (Å) | Interplanar Spacing d (Å) | Relative Intensity $I/I_o$ (Å) |
|---|---|---|---|
| 11.18 | 74 | 3.73 | 46 |
| 10.06 | 51 | 3.65 | 29 |
| 9.96 | 51 | 3.60 | 3 |
| 9.76 | 14 | 3.49 | 5 |
| 9.03 | 1 | 3.45 | 10 |
| 7.46 | 5 | 3.36 | 7 |
| 7.08 | 2 | 3.31 | 9 |
| 6.72 | 6 | 3.26 | 3 |
| 6.37 | 11 | 3.05 | 13 |
| 6.01 | 13 | 3.00 | 13 |
| 5.72 | 7 | 2.93 | 14 |
| 5.56 | 10 | 2.94 | 8 |
| 5.38 | 3 | | |
| 5.16 | 2 | | |
| 5.03 | 6 | | |
| 4.98 | 7 | | |
| 4.62 | 5 | | |
| 4.37 | 6 | | |
| 4.27 | 13 | | |
| 4.09 | 5 | | |
| 4.01 | 6 | | |
| 3.86 | 100 | | |
| 3.82 | 67 | | |
| 3.76 | 38 | | |

This x-ray analysis was carried out by the ordinary procedure of x-ray powder diffraction. The radiation was made of the K alpha doublet of copper and the intensities of the x-ray tube were 40 L KV and 70 mA, respectively. The angle of diffraction 20, and the intensity of diffraction beam were measured by the use of a scintillation counter provided with a goniometer and a strip chart pen recorder. In this case, the scanning speed was 2°/minute for 20 rotation and the time constant for the rate meter was fixed at 1 second.

By using 15 ml of a 5 weight percent ammonium chloride solution per g of zeolite, 25 g of the TSZ product was subjected to ion-exchange treatment a total of four times at 80° C. Each cycle of the treatment was continued for two hours. Then the product of ion-exchange treatment was thoroughly washed with water, dried at 110° C., and calcined in air at 540° C. for three hours, yielding an H (hydrogen)-form TSZ. On chemical analysis, this H-TSZ was found to contain 0.02 weight percent of $Na_2O$.

Subsequently, this H-TSZ was kneaded, in the presence of water, with a separately prepared alumina binder added thereto in an amoont corresponding to 30 weight percent $Al_2O_3$. The resultant mixture was extruded to produce pellets of 1.5 mm in diameter, and the pellets were calcined further in air at 400° C. Nickel was incorporated into the pellets by subjecting the pellets to ion-exchange treatment at 80° C. for 3 hours, using 3 ml of a 1N aqueous solution of nickel nitrate per 1 g of the aforementioned TSZ pellets. Thereafter, the pellets were thoroughly washed with water, dried at 110° C., and calcined in air at 540° C. for three hours. Consequently, there was obtained Ni,H-TSZ. On chermical analysis it was found to contain 0.81 weight percent of Ni.

The hydrofining catalyst was of the commonly used type obtained by having at least one member from among Ni, Co, Mo and W compounds impregnated on alumina or silica-alumina.

EXAMPLE 2

The raw oils fed to the manufacturing process were distillates of boiling points in the range of 330° F. to 900° F. (165.6° C. to 482.2° C.) as illustrated in Table 3, which were obtained by distilling Arabian Light and Iranian Light, respectively.

TABLE 3

| | Raw Oil Used for Manufacture | |
|---|---|---|
| Raw Oil No. | 1 | 2 |
| Crude Oil | Arabian Light | Iranian Light |
| Specific Gravity (15/4° C.) | 0.8812 | 0.8857 |
| Sulfur Content (weight percent) | 1.68 | 1.49 |
| Nitrogen Content (weight, ppm) | 269 | 490 |

TABLE 3-continued

| | Raw Oil Used for Manufacture | |
|---|---|---|
| Pour Point (°C.) | +17.5 | +2.0 |
| Kinematic Viscosity (cst at 210° F.) | 3.09 | 3.54 |
| Distillation °C. (°F.) | | |
| Initial Boiling Point | 189 (372) | 174 (345) |
| 5% | 304 (580) | 284 (543) |
| 10% | 338 (641) | 322 (612) |
| 30% | 371 (700) | 369 (697) |
| 50% | 386 (727) | 390 (734) |
| 70% | 402 (755) | 410 (771) |
| 90% | 424 (796) | 445 (833) |
| 95% | 436 (817) | 459 (858) |

Each of the raw oils obtained as described above was subjected to catalytic dewaxing using the catalyst of Example 1. Of the oil resulting from the catalytic dewaxing treatment, the fraction boiling at or above 550° F. (287.8° C.) was forwarded as feed oil to the stage for hydrofining to afford a petroleum product of low pour point (FIG. 1). The results were as shown in Table 4.

TABLE 4

| Run | Example 2 (1) | Example 2 (2) | Example 2 (3) | Example 2 (4) |
|---|---|---|---|---|
| Catalytic Dewaxing Operating Conditions | | | | |
| Raw Oil | Distillate from Arabian Light (Table 3-1) | | | Distillate from Iranian Oil (Table 3-2) |
| Temperature (°C.) | 320 | 370 | 340 | 320 |
| Liquid Space Velocity (V/H/V) | 2.0 | 3.0 | 1.0 | 2.0 |
| Pressure (kg/cm$^2$ G) | 42 | 42 | 14 | 42 |
| Feed Gas Rate (liters of gas/liter of raw oil) | 445 | 445 | 70 | 445 |
| Hydrofining Operating Conditions | | | | |
| Feed oil | Distillate (550° F. min.) from oil resulting from catalytic dewaxing treatment | | | |
| Catalyst (4.5 wt % NiO, 15.5 wt % $MoO_3$) | Ni—Mo/$Al_2O_3$ | | | |
| Temperature (°C.) | 320 | 320 | 360 | 320 |
| Liquid Space Velocity (V/H/V) | 0.6 | 0.6 | 1.0 | 0.6 |
| Pressure (kg/cm$^2$ G) | 55 | 55 | 14 | 55 |
| Feed gas rate (liters of gas/liter of raw oil) | 267 | 267 | 267 | 267 |
| Product Oil (Dewaxed/Hydrofined) | | | | |
| Yield* (weight percent based on raw oil) | 75 | 73 | 81 | 78 |
| Pour Point (°C.) | −40 | −32.5 | −30 | −35 |
| Kinematic Voscisity (cst at 37.7° C. or 100° F.) | 15.31 | 16.47 | 17.72 | 15.79 |
| (cst at 98.9° C. or 210° F.) | 3.23 | 3.31 | 3.47 | 3.51 |
| Sulfur Content (weight percent) | 0.25 | 0.24 | 0.11 | 0.21 |
| Nitrogen Content (w/ppm) | 65 | 68 | 91 | 195 |

*550° F.+ distillate of product oil

EXAMPLE 3

Figure 2:
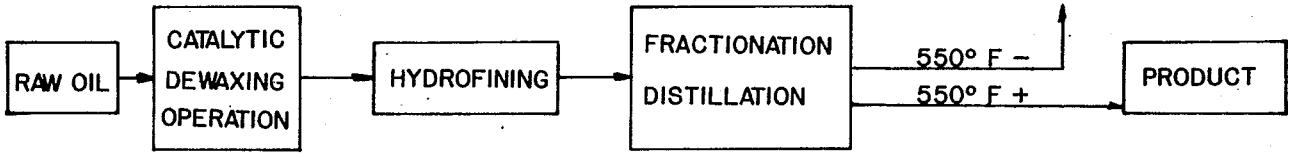

A raw oil indicated in Table 5 was subjected to catalytic dewaxing using the catalyst of Example 1. The oil resulting from the catalytic dewaxing was directly forwarded as a feed oil to hydrofining to obtain a product of low pour point (FIG. 2). The results are shown in Table 5.

TABLE 5

| | Example 3 (1) | Example 3 (2) |
|---|---|---|
| Catalytic Operating Conditions | | |
| Raw Oil | Distillate from Arabian Light (Table 3-1) | Distillate from Arabian Light (Table 3-1) |
| Temperature (°C.) | 320 | 340 |
| Liquid space velocity (V/H/V) | 2.0 - Same as Example 2 (1) | 1.0 - Same as Example 2 (3) |
| Pressure (kg/cm$^2$ G) | 42 | 14 |
| Feed Gas Rate (liters of gas/liter of raw oil) | 445 | 70 |

TABLE 5-continued

| | Example 3 (1) | Example 3 (2) |
|---|---|---|
| Hydrofining Operating Conditions | | |
| Feed Oil | Oil resulting from catalytic dewaxing treatment directly as feed | |
| Catalyst (4.5 wt % NiO/15.5 wt % $MoO_3$) | Ni—Mo/$Al_2O_3$ | |
| Temperature (°C.) | 320 - Same as | - Same as |
| Liquid Space Velocity (V/H/V) | 0.6 Example 2 (1) | 1.0 Example 2 (3) |
| Pressure (kg/cm$^2$ G) | 55 | 14 |
| Feed Gas Rate (liters of gas/liter of raw oil) | 267 | 267 |
| Product Oil (Dewaxed/Hydrofined) | | |
| Yield* (weight percent based on raw oil) | 76 | 81 |
| Pour Point (°C.) | −40 | −30 |
| Kinematic Viscosity | | |
| (cst at 37.7° C.) | 15.16 | 17.69 |
| (cst at 98.9° C.) | 3.21 | 3.46 |
| Sulfur Content (weight percent) | 0.14 | 0.11 |
| Nitrogen Content (w/ppm) | 64 | 93 |

*550° F.$^+$ distillate of product oil

EXAMPLE 4

Figure 3:
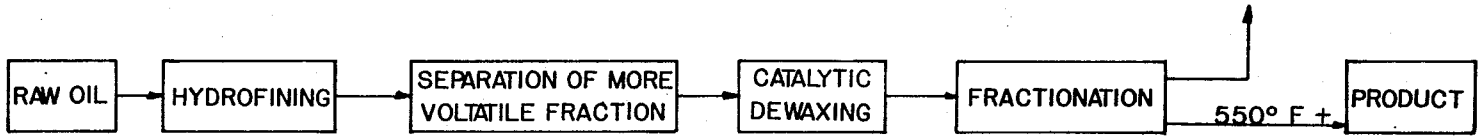

The raw oils indicated in Table 6 were first treated by hydrofining. Then the oils resulting from the hydrofining were fractionated to remove the more volatile portion and forwarded to the stage for catalytic dewaxing using the catalyst shown in Example 1, to obtain a product of low pour point (FIG. 3). The results were as shown in Table 6.

TABLE 6

| | Example 4 (1) | Example 4 (2) | Example 4 (3) | Example 4 (4) |
|---|---|---|---|---|
| Catalytic Dewaxing Operating Conditions | | | | |
| Raw Oil | Distillate from Arabian Light (Table 3-1) | | Distillate from Iranian Oil (Table 3-2) | Distillate from Arabian Light (Table 3-1) |
| Catalyst (4.5 wt % NiO/15.5 wt % $MoO_3$) | Ni—Mo/$Al_2O_3$ | | | |
| Temperature (°C.) | 320 | 360 | 320 | 355 |
| Liquid Space Velocity (V/H/V) | 0.6 | 1.0 | 0.6 | 1.0 |
| Pressure (kg/cm$^2$ G) | 55 | 14 | 55 | 42 |
| Feed Gas Rate (liters of gas/liter of raw oil) | 267 | 267 | 267 | 445 |
| Hydrofining Operating Conditions | | | | |
| Feed Oil | Oil from hydrofining, divested of more volatile portion and feed | | | |
| Temperature (°C.) | 320 | 340 | 320 | 300 |
| Liquid Space Velocity (V/H/V) | 2.0 | 1.0 | 2.0 | 3.0 |
| Pressure (kg/cm$^2$ G) | 42 | 14 | 42 | 42 |
| Feed Gas Rate (liters of gas/liter of raw oil) | 445 | 70 | 445 | 445 |
| Product Oil (Dewaxed/Hydrofined) | | | | |
| Yield* (weight percent based on raw oil) | 75 | 80 | 77 | 84 |
| Pour Point (°C.) | −40 | −32.5 | −35.0 | −25.0 |
| Kinematic Viscosity | | | | |
| (cst at 37.7° C.) | 15.07 | 17.74 | 15.68 | 21.32 |
| (cst at 98.9° C.) | 3.17 | 3.50 | 3.46 | 3.89 |
| Sulfur Content (weight percent) | 0.23 | 0.12 | 0.21 | 0.09 |
| Nitrogen Content (w/ppm) | 62 | 93 | 189 | 52 |

*550° F. distillate of product oil

EXAMPLE 5

The distillates boiling between 550° F. and 725° F. (287.8° C. and 385° C.), originating in the products of Examples 2–4, were found to be usable as insulating oils (Table 7).

EXAMPLE 6

The distillates boiling more than 725° F. (385° C.), originating in the products of Examples 2–4 were found to be usable as refrigerating machine oils (Table 8).

EXAMPLE 7

The products of Examples 2–4, when subjected to an aftertreatment (either hydrofining or treatment with clay), yielded insulating oils or refrigerating machine oils. The aftertreatment serves to improve the product quality (Table 9).

TABLE 7

| Product oil (procedure) | Example 5 (1) Example 2 (1) | Example 5 (2) Example 2 (3) | Example 5 (3) Example 2 (4) | Example 5 (4) Example 3 (1) | Example 5 (5) Example 4 (1) | Example 5 (6) Example 4 (3) | Example 5 (7) Example 4 (4) | Insulating oil No. 2 JIS C-2320 |
|---|---|---|---|---|---|---|---|---|
| Properties of insulating oil | | | | | | | | |
| Specific gravity (15/4° C.) | 0.902 | 0.894 | 0.899 | 0.902 | 0.901 | 0.898 | 0.908 | <0.92 |
| Kinematic viscosity | | | | | | | | |
| (cst at 30° C.) | 14.56 | 15.83 | 15.14 | 14.58 | 14.55 | 15.23 | 18.92 | <19.0 |
| (cst at 75° C.) | 3.11 | 3.29 | 3.46 | 3.12 | 3.10 | 3.49 | 4.89 | <5.5 |
| Pour point (°C.) | <−42.5 | −32.5 | −40 | −42.5 | −42.5 | −40 | −27.5 | <−27.5 |
| Flash point (°C.) | 166 | 158 | 163 | 164 | 167 | 166 | 170 | <130 |
| Amount of vaporization (%) | 0.16 | 0.19 | 0.16 | 0.16 | 0.15 | 0.14 | 0.12 | <0.4 |
| Reaction | Neutral | Neutral | Neutral | Neutral | Neutral | Neutral | Neutral | Neutral |
| Total acid number (mg/kOH/g) | <0.01 | <0.01 | 0.018 | <0.01 | <0.01 | <0.01 | <0.01 | <0.02 |
| Corrosiveness, discoloration number (at 100° C., 3 hrs) | <1 | <1 | <1 | <1 | <1 | <1 | <1 | <1 |
| Stability | | | | | | | | |
| (Sludge, % | 0.11 | 0.13 | 0.21 | 0.09 | 0.12 | 0.23 | 0.10 | <0.040 |
| Total acid number (mg kOH/g) | 0.39 | 0.14 | 0.58 | 0.38 | 0.40 | 0.58 | 0.37 | <0.60 |
| Insulating breaking voltage (kV) | >40 | >40 | >4.0 | >40 | >40 | >40 | >40 | >30 |
| Volume resistivity (Ω · cm) | $>1 \times 10^{13}$ | $>1 \times 10^{12}$ | $>1 \times 10^{13}$ | $>1/10^{13}$ | $>1 \times 10^{13}$ | $>1 \times 10^{13}$ | $>1 \times 10^{13}$ | $>5 \times 10^{12}$ |
| Yield of insulating oil* (based on raw oil) | | | | | | | | |

*550° F.–725° F. distillate of product oil

TABLE 8

| Product oil (procedure) | Example 6 (1) Example 2 (1) | Example 6 (2) Example 2 (2) | Example 6 (3) Example 2 (4) | Example 6 (4) Example 3 (1) | Example 6 (5) Example 4 (1) | Example 6 (6) Example 4 (2) | Refrigerating Machine oil No. 2 JIS k-2211 |
|---|---|---|---|---|---|---|---|
| Properties of refrigerating machine oil | | | | | | | |
| Color (Union) | 2(−) | 1½ | 2½ | 2 | 2 | 2½ | <2½ |
| Reaction | Natural | Natural | Neutral | Neutral | Neutral | Neutral | Neutral |
| Flash point (°C.) | 186 | 192 | 190 | 185 | 182 | 196 | >155 |
| Klnematic viscosity | | | | | | | |
| (cst at 30° C.) | 34.01 | 38.12 | 36.13 | 34.41 | 34.21 | 40.72 | 32.42 |
| (cst at 50° C.) | 13.97 | 14.61 | 14.26 | 14.02 | 14.01 | 16.38 | >13.5 |
| Corrosion of copper sheet (100° C. × 3 hrs) | <1 | <1 | <1 | <1 | <1 | <1 | <1 |
| Pour point (°C.) | −35 | −27.5 | −30 | −35 | −35 | −27.5 | −27.5 |
| Crackle test | Passed | Passed | passed | passed | passed | passed | passed |
| Yield of refrigerating machine oil* (wt % based on raw oil) | 42 | 41 | 45 | 43 | 42 | | |

*725° F.+ distillate of product oil

TABLE 9

| Catalytic dewaxing/Hydrofining Product oil (procedure) | Example 7 (1) Example 4 (3) | Example 7 (2) Example 4 (3) | Example 7 (3) Example 3 (2) |
|---|---|---|---|
| Range of boiling points of product oil (°F.) | 550~725 | 550~725 | 725 ~ |
| Type of aftertreatment and operating conditions | Hydrofining 320° C. 0.6 V/H/V 55 kg/cm 1,500 SCF/B | Treatment with clay Raw oil brought into contact with 2 wt % of clay based on oil at 120° C. | Treatment with clay Raw oil brought into contact with 2 wt % of clay based on oil at 120° C. |
| Final product and properties | Insulating oil | Insulating oil | Insulating oil |
| Kinematic viscosity | | | |
| (cst at 30° C.) | 14.86 | 16.12 | 41.23 |
| (cst at 75° C.) | 3.32 | 3.61 | 16.52 |
| Pour point (°C.) | −40 | −40 | — |
| Stability: Sludge (%) | 0.09 | 0.06 | — |
| Stability: Total acid number (mg KOH/g) | 0.37 | 0.23 | — |
| Color (Union) | — | — | 1 |

COMPARATIVE EXAMPLES

As a catalyst for use in catalytic dewaxing, a zeolite ZSM-5 was prepared in its nickel-hydrogen form as follows:

In 165 g of purified water, 6.1 g of aluminum sulfate was dissolved. By mixing the resultant solution with 12 g of concentrated sulfuric acid (95 weight percent) and 21 g of tetrapropyl ammonium bromide (TPA Br), there was obtained a mixed solution (Solution A). Then another mixed solution (Solution B) was prepared by using 100 g of purified water and 165 g of water glass (containing 9.4 weight percent of $Na_2O$ and 29.4 weight percent of $SiO_2$). Further, an aqueous solution of sodium chloride was prepared by dissolving 63 g of sodium chloride in 250 g of purified water. The aforementioned Solution A and Solution B were simultaneously added dropwise, under stirring, into the sodium chloride solution. Consequently, there was obtained an aqus reaction mixture having a composition expressed in molar ratio of oxides as 4.3 $(TPA)_2O.6Na_2O.Al_2O_3.8$-$8SiO_2.5735H_2O$. This aqueous reaction mixture was placed in a stainless steel autoclave, heated to an elevated temperature, and kept at 160° C. for 20 hours under the autogenous pressure. A solid product was separated by filtration, washed with water, and dried at 110° C. When the crystalline solid product was analyzed by an x-ray powder diffraction method the diffraction pattern was consistent with that of ZSM-5 shown in U.S. Pat. No. 3,702,886.

25 g of ZSM-5 was calcined in air at 540° C. for three hours. It was then subjected to ion-exchange treatment a total of four times at 80° C. using 15 ml of 5 weight percent ammonium chloride solution per g of zeolite. Each cycle of the treatment was continued for 1.5 hours. Then the product resulting from the ion-exchange treatment was thoroughly washed with water, then dried at 110° C., and subsequently calcined in air at 540° C. for three hours to prepare an H (hydrogen)-form ZSM-5. On chemical analysis the H-ZSM-5 was found to have a composition of 0.02 weight percent of $Na_2O$, 3.18 weight percent of $Al_2O_3$, and 96.60 weight percent of $SiO_2$ ($SiO_2/Al_2O_3=51.6$).

Then the H-ZSM-5 was kneaded with a separately prepared alumina binder in an amount corresponding to 30 weight percent $Al_2O_3$. The resultant mixture was extruded to produce pellets 1.5 mm in diameter. The pellets were dried at 110° C. and further calcined in air at 400° C. To make a Ni, H-from ZSM-5, the ZSM-5 pellets were subjected to ion-exchange treatment at 80° C. for three hours, using 3 ml of a 1N aqueous solution of nickel nitrate per g of the pellets. They were then washed thoroughly with water, dried at 110° C., and calcined at 540° C. for three hours. On chemical analysis, the Ni, H-ZSM-5 was found to contain 0.77 weight percent of Ni.

Table 10 shows Comparative Examples 1–2 which were conducted by using the aforementioned Ni, H-ZSM-5 as a catalyst for catalytic dewaxing, by way of comparison under the conditions and on the feeds of Example 2(1) and Example 3(1), respectively. Table 11 shows Comparative Example 3 which was conducted by using the NI, H-ZSM-5 in catalytic dewaxing by way of comparison under the conditions and on the feed of Example 4(1).

TABLE 10

| | Comparative Example 1 | Comparative Example 2 |
|---|---|---|
| Catalytic Dewaxing Operating Conditions | | |
| Raw Oil | Distillate from Arabian Light (Table 3-1) | Distillate from Arabian Light (Table 3-1) |
| Temperature (°C.) | 320 | 320 |
| Liquid space velocity (V/H/V) | 2.0 | 2.0 |
| Pressure (kg/cm$^2$ G) | 42 | 42 |
| Feed gas rate (liters of gas/liter of raw oil) | 447 | 447 |
| Hydrofining Operating Conditions | | |
| Feed Oil | Distillate from dewaxing, boiling more than 550° F. | Oil from dewaxing fed directly to hydrofining |
| Catalyst (4.5 wt % NiO, 15.5 wt % $MoO_3$) | Ni—Mo/$Al_2O_3$ | |
| Temperature (°C.) | 320 | 320 |
| Liquid Space Velocity (V/H/V) | 0.6 | 0.6 |
| Pressure (kg/cm$^2$ G) | 55 | 55 |
| Feed Gas Rate (liters of gas/liter of raw oil) | 267 | 267 |
| Product Oil (Dewaxed/Hydrofined) | | |
| Yield* (weight percent based on raw oil) | 76 | 76 |
| Pour Point (°C.) | −35 | −35 |
| Kinematic Viscosity | | |
| (cst at 37.7° C.) | 16.88 | 16.51 |
| (cst at 98.9° C.) | 3.35 | 3.32 |
| Sulfur Content (weight percent) | 0.25 | 0.26 |
| Nitrogen Content (w/ppm) | 65 | 64 |

*550° F.$^+$ distillate of product oil

TABLE 11

| | Comparative Example 3 |
|---|---|
| Hydrofining Operating Conditions | |
| Raw Oil | Distillate from Arabian Light (table 3-1) |
| Catalyst | Ni—Mo/$Al_2O_3$ |
| Temperature (°C.) | 320 |
| Liquid Space Velocity (V/H/V) | 0.6 |
| Pressure (kg/cm$^2$ G) | 55 |
| Feed Gas Rate (liters of gas/liter of raw oil) | 267 |
| Catalytic Dewaxing Operating Conditions | |
| Feed Oil | Oil from hydrofining divested of more volatile fraction and then fed into cat dewaxing |
| Temperature (°C.) | 320 |
| Liquid Space Velocity (V/H/V) | 2.0 |
| Pressure (kg/cm$^2$ G) | 42 |
| Feed Gas Rate (liters of gas/liter of raw oil) | 447 |
| Product Oil (Dewaxed/Hydrofined) | |
| Yield* (weight percent based on raw oil) | 74 |
| Pour Point (°C.) | −35 |
| Kinematic Viscosity | |
| (cst at 37.7° C.) | 15.66 |
| (cst at 98.9° C.) | 3.34 |
| Sulfur Content (weight percent) | 0.24 |
| Nitrogen Content (w/ppm) | 67 |

*550° F.$^+$ Distillate of product oil

The results indicated above prove that the manufacturing method contemplated by the present invention is capable of affording petroleum products of low pour point.

Table 12 shows comparative Examples 4(1) through (3) which report the properties of insulating oils from the distillate fraction boiling between 550° F. and 725° F. (287.8° C. and 385° C.) of the oils obtained in Comparative Examples 1 through 3. These results are to be compared with Examples 5(1), (4), and (5), respectively.

Table 13 shows Comparative Examples 5(1) through (3) which report the properties of refrigerating machine oils from the distillate fraction boiling about 725° F. (385° C.) of the oils obtained in Comparative Examples 1 through 3. These results are to be compared with Examples 6(1), (4), and (5), respectively.

These results prove that in accordance with the manufacturing method contemplated by the present invention petroleum products of lower pour point and better quality can be produced.

TABLE 12

| Product Oil (procedure) | Comparative Example 4 (1) Comparative Example 1 | Comparative Example 4 (2) Comparative Example 2 | Comparative Example 4 (3) Comparative Example 3 |
|---|---|---|---|
| Properties of insulating oil | | | |
| Specific gravity (15/4° C.) | 0.900 | 0.903 | 0.900 |
| Kinematic viscosity | | | |
| (at 30° C.) | 15.01 | 14.99 | 14.68 |
| (at 70° C.) | 3.10 | 3.31 | 3.00 |
| Pour point (°C.) | −37.5 | −37.5 | −37.5 |
| Flash point (°C.) | 170 | 168 | 167 |
| Amount of vaporization (%) | 0.18 | 0.17 | 0.17 |
| Reaction | Neutral | Neutral | Neutral |
| Total acid number (mg KOH/g) | <0.01 | <0.01 | <0.01 |
| Corrosiveness, discoloration No. (100° C., 3 hrs) | <1 | <1 | <1 |
| Stability | | | |
| Sludge (%) | 0.13 | 0.11 | 0.14 |
| Total acid number (mg KOH/g) | 0.41 | 0.40 | 0.38 |
| Insulation breaking voltage (KV) | >40 | >40 | >40 |
| Volume resistivity (Ω-cm) | $>1 \times 10^{13}$ | $>1 \times 10^{13}$ | $>1 \times 10^{13}$ |
| Yield of insulation oil* (wt % based on raw oil) | 32 | 30 | 32 |

*550° F.-625° F. distillate of product oil

TABLE 13

| Product Oil (procedure) | Comparative Example 5 (1) Comparative Example 1 | Comparative Example 5 (2) Comparative Example 2 | Comparative Example 5 (3) Comparative Example 3 |
|---|---|---|---|
| Properties of refrigerating machine oil | | | |
| Color (Union) | 2(−) | 2 | 2 |
| Reaction | Neutral | Neutral | Neutral |
| Flash point (°C.) | 170 | 188 | 191 |
| Kinematic viscosity | | | |
| (cst at 30° C.) | 37.58 | 35.16 | 39.98 |
| (cst at 50° C.) | 14.01 | 13.81 | 15.16 |
| Corrosion of copper (100° C. × 3 hrs) | 1 | 1 | 1 |
| Pour point (°C.) | −30 | −30 | −30 |
| Crackle test | Passed | Passed | Passed |
| Yield of refrigerating machine oil* (wt % based on raw oil) | 44 | 42 | 45 |

*725° F. + distillate of product oil

What is claimed is:

1. A method for manufacturing a low pour point petroleum product, which comprises fractionating a paraffin-based crude oil into a distillate with boiling points in the range of 330° F. to 900° F. (165° C. to 482° C.), contacting said distillate with hydrogen and a catalyst comprising zeolite TSZ which zeolite is a crystalline alumino-silicate having the formula in terms of mole ratio of oxides:

$$0.8\text{–}1.5M_{2/n}O:Al_2O_3:10\text{–}100SiO_2:ZH_2O$$

wherein M denotes at least one metallic cation species, n is the valancy of the metallic cation, and Z is a numeral of the value of 0 to 40, which zeolite possesses the X-ray powder diffraction pattern which shows the significant lines as set forth in Table 1, thereby effecting catalytic hydrodewaxing of said distillate, fractionating the product resulting from said catalytic hydrodewaxing, contacting the fractionated-hydrodewaxed distillate oil with a hydrofining catalyst under standard hydrofining conditions, and separating the lighter fraction produced by said hydrofining and recovering a catalytically hydrodewaxed-hydrofined oil product.

2. A method for manufacturing a low pour point petroleum product, which comprises fractionating a paraffin-based crude oil into a distillate with boiling points in the range of 330° F. to 900° F. (165° C. to 482° C.), contacting said distillate with hydrogen and a catalyst comprising zeolite TSZ which zeolite is a crystalline alumino-silicate having the formula in terms of mole ratio of oxides:

$$0.8\text{–}1.5M_{2/n}O:Al_2O_3:10\text{–}100SiO_2:ZH_2O$$

wherein M denotes at least one metallic cation species, n is the valancy of the metallic cation, and Z is a numeral of the value of 0 to 40, which zeolite possesses the X-ray powder diffraction pattern which shows the significant lines as set forth in Table 1, thereby effecting the catalytic hydrodewaxing of said distillate, contacting the oil resulting from said catalytic hydrodewaxing with a hydrofining catalyst under standard hydrofining conditions thereby effecting hydrofining of said oil, and separating the lighter fraction produced by said hydrofining and recovering a catalytically hydrodewaxed-hydrofined oil product.

3. A method for manufacturing a low pour point petroleum product, which comprises fractionating a paraffin-based crude oil into a distillate with boiling points in the range of 330° F. to 900° F. (165° C. to 482° C.), contacting said distillate with a hydrofining catalyst under standard hydrofining conditions thereby effecting hydrofining of said distillate, separating the lighter fraction from the oil resulting from said hydrofining and recovering a hydrofined oil fraction, then contacting said recovered oil fraction with hydrogen and a catalyst comprising zeolite TSZ which zeolite is a crystalline alumino-silicate having the formula in terms of mole ratio of oxides:

$$0.8\text{–}1.5M_{2/n}O:Al_2O_3:10\text{–}100SiO_2:ZH_2O$$

wherein M denotes at least one metallic cation species, n is the valancy of the metallic cation, and Z is a numeral of the value 0 to 40, which zeolite possesses the X-ray powder diffraction pattern which shows the significant lines as set forth in Table 1, thereby effecting catalytic hydrodewaxing of said oil, and fractionating the product resulting from said catalytic hydrodewaxing to recover a hydrofined-catalytically hydrodewaxed oil product.

4. The method according to claim 1, 2 or 3 wherein said catalytic hydrodewaxing is carried out at a temperature in the range of 260° C. to 400° C., a liquid space velocity in the range of 0.1 to 5.0 V/H/V, a pressure in the range of 10 to 60 kg/cm$^2$G, and a feed gas rate in the range of 35 to 900 liters of gas/liter of oil and said hydrofining is carried out at a temperature in the range of 250° C. to 370° C., a liquid space velocity in the range of 0.1 to 5.0 V/H/V, a pressure in the range of 10 to 60 kg/cm$^2$G, and a feed gas rate in the range of 35 to 900 liters of gas/liter of oil.

5. The method according to claim 1, 2 or 3 wherein said catalyst comprising zeolite TSZ contains a binder.

6. The method according to claim 1, 2 or 3 wherein said catalyst comprising zeolite TSZ consists solely of zeolite TSZ.

7. The method of claim 1 wherein the fractionated catalytically hydrodewaxed fraction which is hydrofined is that fraction boiling at or about 550° F. (287.8° C.).

8. The method of claim 1, 2 or 3 wherein the zeolite TSZ is in the hydrogen form.

9. The method of claim 1, 2 or 3 wherein the zeolite TSZ is impregnated with at least one member selected from the group consisting of Group VIII and Group IIA.

10. The method of claim 5 wherein the zeolite TSZ is impregnated with at least one member selected from the group consisting of Group VIII and Group IIA.

11. The method of claim 6 wherein the zeolite TSZ is in the hydrogen form.

12. The method of claim 11 wherein the hydrogen form zeolite TSZ is impregnated with at least one member selected from the group consisting of Group VIII and Group IIA.

* * * * *